US007952292B2

(12) United States Patent
Vegter et al.

(10) Patent No.: US 7,952,292 B2
(45) Date of Patent: May 31, 2011

(54) ILLUMINATION CONTROL

(75) Inventors: Klaas Vegter, Eindhoven (NL); Johan Paul Marie Gerard Linnartz, Eindhoven (NL); Sel-Brian Colak, Eindhoven (NL); Nebojsa Fisekovic, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 410 days.

(21) Appl. No.: 11/912,166

(22) PCT Filed: Apr. 19, 2006

(86) PCT No.: PCT/IB2006/051211

§ 371 (c)(1),
(2), (4) Date: Oct. 22, 2007

(87) PCT Pub. No.: WO2006/111930

PCT Pub. Date: Oct. 26, 2006

(65) Prior Publication Data

US 2008/0185969 A1 Aug. 7, 2008

(30) Foreign Application Priority Data

Apr. 22, 2005 (EP) ..... 05103279
Apr. 22, 2005 (EP) ..... 05103292
Dec. 21, 2005 (EP) ..... 05112561

(51) Int. Cl.
*H05B 41/36* (2006.01)

(52) U.S. Cl. ..... 315/153; 315/149; 315/150

(58) Field of Classification Search ..... 315/149–155, 315/157, 159, 185 R, 186, 192, 291, 294, 315/295, 299, 300; 340/310.11, 310.12
See application file for complete search history.

(56) References Cited

U.S. PATENT DOCUMENTS

| | | | |
|---|---|---|---|
| 4,779,266 | A | 10/1988 | Chung et al. |
| 6,271,815 | B1 | 8/2001 | Yang et al. |
| 6,445,369 | B1 | 9/2002 | Yang et al. |
| 2002/0043938 | A1 | 4/2002 | Lys |
| 2003/0107888 | A1 | 6/2003 | Devlin et al. |

FOREIGN PATENT DOCUMENTS

| | | | |
|---|---|---|---|
| JP | 2001176676 | A1 | 6/2001 |
| JP | 11331086 | A1 | 3/2008 |
| WO | 0133914 | A1 | 5/2001 |
| WO | 2004057927 | A1 | 7/2004 |

OTHER PUBLICATIONS

Grantham Pang, et al: Optical Wireless Based on High Brightness Visible LEDs, Conf. 1999 IEEE, pp. 1693-1699.
Grantham Pang, et al: LED Wireless, Industry Applications Magazine, IEEE vol. 8, Issue 1, Jan.-Feb. 2002, pp. 21-28.

*Primary Examiner* — Douglas W Owens
*Assistant Examiner* — Jianzi Chen
(74) *Attorney, Agent, or Firm* — John F. Salazar; Mark L. Beloborodov

(57) ABSTRACT

Controlling a lighting system, which comprises a controller (2, 10), lighting units (6), and a sensing device. Each lighting unit comprises a lighting source (12) and a modulated light source (14). A single light source may be used to function as both the lighting source and the modulated light source. Each modulated light source emits uniquely modulated light. A radiation pattern of each modulated light source coincides substantially with a radiation pattern of a lighting source of the same lighting unit. The sensing device is suitable to sense modulated light in a viewing area. Lighting units from which the sensing device senses modulated light are identified from the modulation of that modulated light. The sensing device measures the intensity of the modulated light from the identified lighting unit. The lighting sources are controlled dependent on control data which comprises measuring values of measured light intensities.

16 Claims, 3 Drawing Sheets

ILLUMINATION CONTROL

FIELD OF THE INVENTION

The invention relates to a method for controlling a lighting system.

BACKGROUND OF THE INVENTION

WO 2004/057927 discloses a method for configuration a wireless controlled lighting system. The prior art system comprises a central master control device, several local control master devices, which are linked to the central master device, and, associated with each local control master device, one or more lighting units and a portable remote control device. Each lighting unit and the portable control device are linked to their associated local control master device by a wireless connection. Light emitted by a lighting unit is modulated by an identification code, which was stored in the lighting unit before controlling the lighting unit. When used, the portable control device must be positioned to receive modulated light from one lighting unit only. The portable control device is suitable to derive the identification code of a lighting unit contained in the received modulated light. The portable control device has a user interface by which a user can enter additional data, which is sent to its associated local control master device together with the identification code received from a lighting unit. Said additional data may contain an indication of a switch or key which the user assigns to the lighting unit to operate the lighting unit from then on, such as for turning on or off. Then, the data is communicated to the central master device for general lighting management.

WO 2004/057927 also discloses that a lighting unit may be equipped with an additional light source, such as a LED device, for transmitting the modulated light instead of using the light source used for normal lighting.

The prior art method and part of the system to carry out such method are related to associate an identification code of a lighting unit or of a group of lighting units with some control means, such as a button or a sequence of buttons, of the remote control device. Different identification codes are associated with different control means, such as buttons, of the remote control device.

With the prior art the control of lighting units is carried out by forward control only, that is, without any kind of feedback about actual lighting conditions and locations of the lighting units. For example, an object can be illuminated by any number of lighting units directly, but also indirectly as a result of reflections. With the prior art system it is not possible to measure lighting effects seen from any of different standpoints of view towards lighting sources or to an object, which is illuminated by any number of lighting sources and to control lighting units dependent on measured and wanted lighting effects.

OBJECT OF THE INVENTION

It is an object of the invention to provide a method which enables to change lighting of a specific area or object, which may be illuminated by different lighting units at the same time, without requiring from a user to indicate specific lighting sources to provide a wanted lighting effect for said area or object

SUMMARY OF THE INVENTION

The above object of the invention is achieved by providing a method as described in claim 1.

Accordingly, illumination of a specific area or object can be changed without requiring from a user to know which lighting sources are responsible for a present lighting of the area or object and which lighting sources need to be controlled and to what extend for obtaining a wanted lighting for the area or object.

The above object of the invention is also achieved by providing a lighting system as described in claim 10.

BRIEF DESCRIPTION OF THE DRAWINGS

The invention will become more gradually apparent from the following exemplary description in connection with the accompanying drawing. In the drawing.

DETAILED DESCRIPTION OF EXAMPLES

Figure 1:
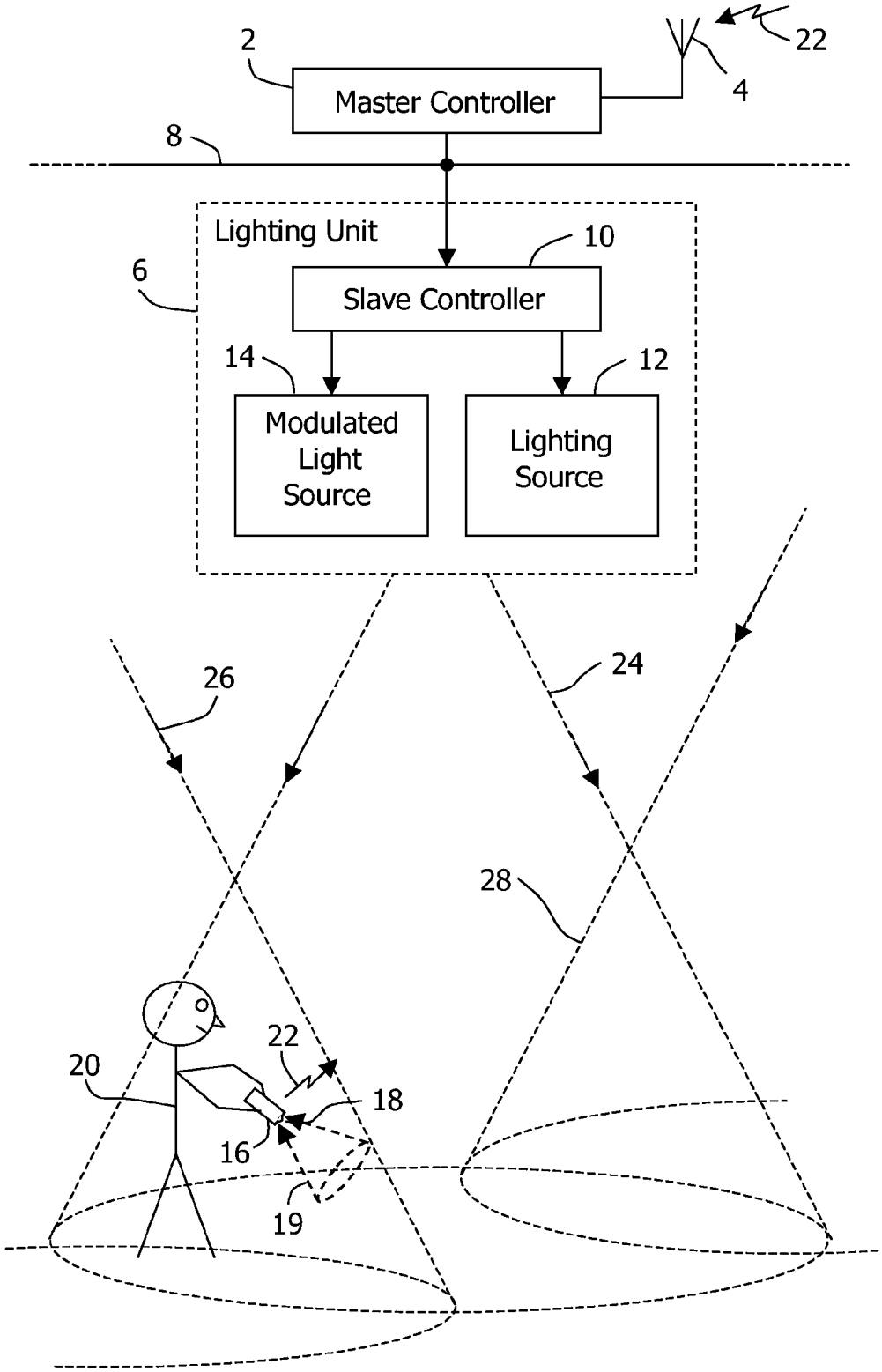
FIG. 1 shows schematically a first embodiment of a lighting system according to the invention.

FIG. 1 shows a first embodiment of a lighting system according to the invention. It comprises a master controller 2, which has a receiver (not shown) for receiving wireless transmissions. To exemplify only, it is assumed here that the receiver is suitable for receiving radio frequency (RF) transmissions. Therefore the receiver is connected to an antenna 4. The system further comprises at least one lighting unit 6. The master controller 2 is linked to the lighting units 6 by a link 8 for communication of data. The link 8 may be of any suitable type, wireless or not.

A lighting unit 6 comprises a slave controller 10, which is connected to the link 8, a lighting source 12 and a modulated light source 14.

The lighting source 12 is a light source for normal lighting and it can be controlled by the slave controller 10 to change a lighting property of the emitted light, such as intensity and color. The slave controller 10 can be controlled by the master controller 2 to control the lighting source 12 accordingly.

The modulated light source 14 is, for example, an infrared light (IR) source. The modulated light source 14 is suitable to emit light which is different from modulated light emitted by other modulated light sources 14, such as by emitting at different instances (or time division emission), using different identifications to modulate with or using spread spectrum modulation. Such emissions of modulated light makes it possible to identify a modulated light source 14 emitting sensed modulated light and thereby the lighting source 12 of the same lighting unit 6. The modulated light may be modulated to carry data about the lighting unit 6, possibly in addition to an identification.

Radiation patterns of the lighting source 12 and of the modulated light source 14 of the same lighting unit 6 are made to coincide substantially.

The lighting system further comprises a remote control device 16. The remote control device 16 has a light-sensing part (or device), which has a light entrance 18 which provides a viewing area, indicated by a cone 19 in FIG. 1, in which the sensing device can adequately sense modulated light. Preferably, the remote control device 16 is a device which can be held by hand by a user 20. The remote control device 16 has wireless transmission means which is suitable for transmitting a signal which can be received by the receiver of the master controller 2, as indicated by arrows 22 near the antenna 4 and the remote control device 16.

FIG. 1 shows an example of coinciding lighting patterns of the lighting source 12 and the modulated light source 14 of the same lighting unit 6, indicated by a cone 24 of a particular light intensity. Radiation patterns of other lighting units 6 are indicated by cones 26 and 28 of the same particular light intensity. In practice, an area or an object will be illuminated with different intensities by several lighting sources 12 directly or indirectly by reflection simultaneously. Therefore, if the user 20 points the remote control device 16 with its viewing area 19 to an object, such as a part of a floor or wall, and/or to one or more lighting units 6, a light sensor (not shown) of the remote control device 16 will sense modulated light which is emitted by modulated light sources 14 of different lighting units 6. At this point, a user 20 who wants to change illumination of an object needs to know which lighting sources 14 may contribute to a wanted illumination of the object and to what extend. The user would also need to know which lighting sources 12 are illuminating other areas or objects in order to maintain said illumination of other areas or objects by the same set or any other set of lighting sources 12. Obviously this will be very difficult and very time consuming for the user 20 to do. The invention provides a solution for this problem.

Figure 2:
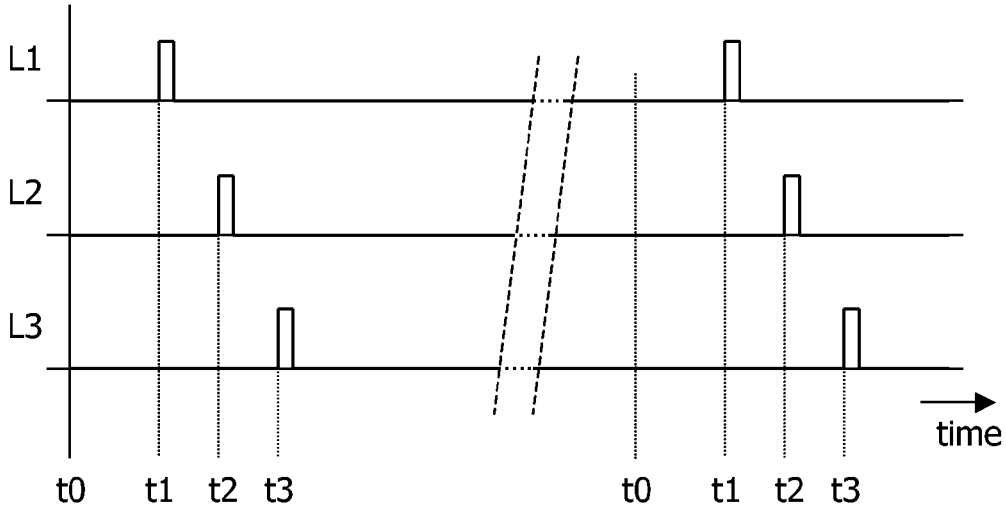
FIG. 2 shows a time diagram of instances to identify different modulated light sources of the system of FIG. 1.

As shown in FIG. 2 different modulated light sources 14, indicated by L1, L2, L3, . . . in FIG. 2, may be controlled by the controller 10 or by the controllers 2 and 10 to emit light on different time instances t1, t2, t3, . . . , respectively. The modulation may be a simple on or off control of the modulated light sources 14 on said instances. The modulation may also be carried out by allocating in advance a unique identification to each modulated light source and to on/off control the modulated light sources 14 on said instances in accordance with the identification code of the emitting modulated light source 14. This type of modulation is in accordance with a modulation technique known as "time-division multiplexing/multiplex access" (TDMA).

If the user 20 operates the remote control device 16 to receive reflected light from an object, which is illuminated by a lighting unit 6, because of the substantially coinciding radiation patterns, the remote control device 16 will receive light from both the lighting source 12 and the modulated light source 14 of that lighting unit 6. The remote control device 16 is suitable to detect a change of intensity of modulated light it received, so that the remote control device or the master controller 2 can identify the modulated light source 14 having emitted the received modulated light with said change of intensity.

In general one wants to control lighting sources 12 which may contribute to a wanted illumination of a particular object. It is of interest then to determine possible contributions by all lighting sources 12 to said illumination. In any different location one may perceive different light contributions reflected by the object. Therefore the remote control device 16, or its sensing device, is suitable to measure the intensity of modulated light received from any modulated light source 14, that is, with a greater resolution than offered by on/on control.

The modulated light sources 14 may emit light constantly or during some period dependent on operation of the remote control device 16 by the user 20. At the time a modulated light source 14 generates and emits light the light has a maximum intensity. The modulated light will diverge according to a radiation pattern of the modulated light source 14. So will light emitted by the lighting device of the same lighting unit 6. Because the lighting source 12 and the modulating light source 14 have substantially coinciding radiation patterns for each lighting source 12 a light contribution to illumination of an object with respect to a maximum contribution level by said source 12 can be determined. Data containing values of intensity measurements on sensed modulated light are sent to the master controller 2. Data about a wanted illumination or illumination change indicated by the user 20 by operating the remote control device 16 is also sent to the master controller. The master controller 2 may control the lighting sources 12 dependent on data it receives from the remote control device 16 and (or inclusive) identifications of modulated light sources 14 which were responsible for the data about light intensities. The master controller 2 may carry out the control also dependent on properties of lighting sources 12, such as about lighting power and aging, acquired in advance or with each emission of light by a modulated light source 14. The control may also be made dependent on actual illumination of other areas or objects, so as to maintain such illumination and to achieve the wanted illumination by what ever combinations of lighting sources 12.

FIG. 1 shows that the modulated light source 14 of a lighting unit 6 is connected to the slave controller 10 of that lighting unit 6. Therefore, the identification code of the lighting unit 6, in fact of its slave controller 10, could be used as identification code for the modulated light source 14 as well.

With the modulated light source 14 of a lighting unit 6 being connected to the slave controller 10 of said lighting unit 6, the master controller 2 may control the slave controller 10 of different lighting units 6 to emit the modulated light at instances, which are determined by the master controller. In other cases the different modulated light sources 14 will emit modulated light at different, unrelated or random instances. The light must be modulated then with an identification code of the emitting modulated light source 14. Because collision of transmissions of modulated light by different modulated light sources 14 may occur then, the modulated light sources 14 are suitable to repeat their emissions at least once and with a random interval between transmissions and the remote control device 16 and the master controller 2 operate to detect modulated light and to process data there from received during at least a longest possible interval of the random interval between transmissions.

It is noted that it is not required that the lighting system comprises a master controller 2 and apart there from one or more slave controllers 10. A master controller (or a controller in general) may be suitable to directly control lighting units 6 without requiring that the lighting units 6 contain a slave controller 10 or that a slave controller is used. A master controller (or a controller in general) may be suitable to directly control lighting units 6.

It is noted also that any lighting source 12 can be of a type which allows modulation of the light emitted by it such that the modulation can not be perceived by humans, such as by very short intervals of on or off switching. In that case a lighting source 12 and a modulated light source 14 of the same lighting unit 6 can be the same source, such as a light emitting diode (LED). There is no need to speak about a lighting unit then, since it can be simply that same light source (LED). Of course measures must be taken that a lighting source emits light at least shortly before the time a user wants to change illumination of an object, which the master controller might use for the illumination. This can be achieved simply during times when a lighting source apparently is turned off by turning on the lighting source intermittently during short intervals, which are not perceivable by humans.

Figure 3:
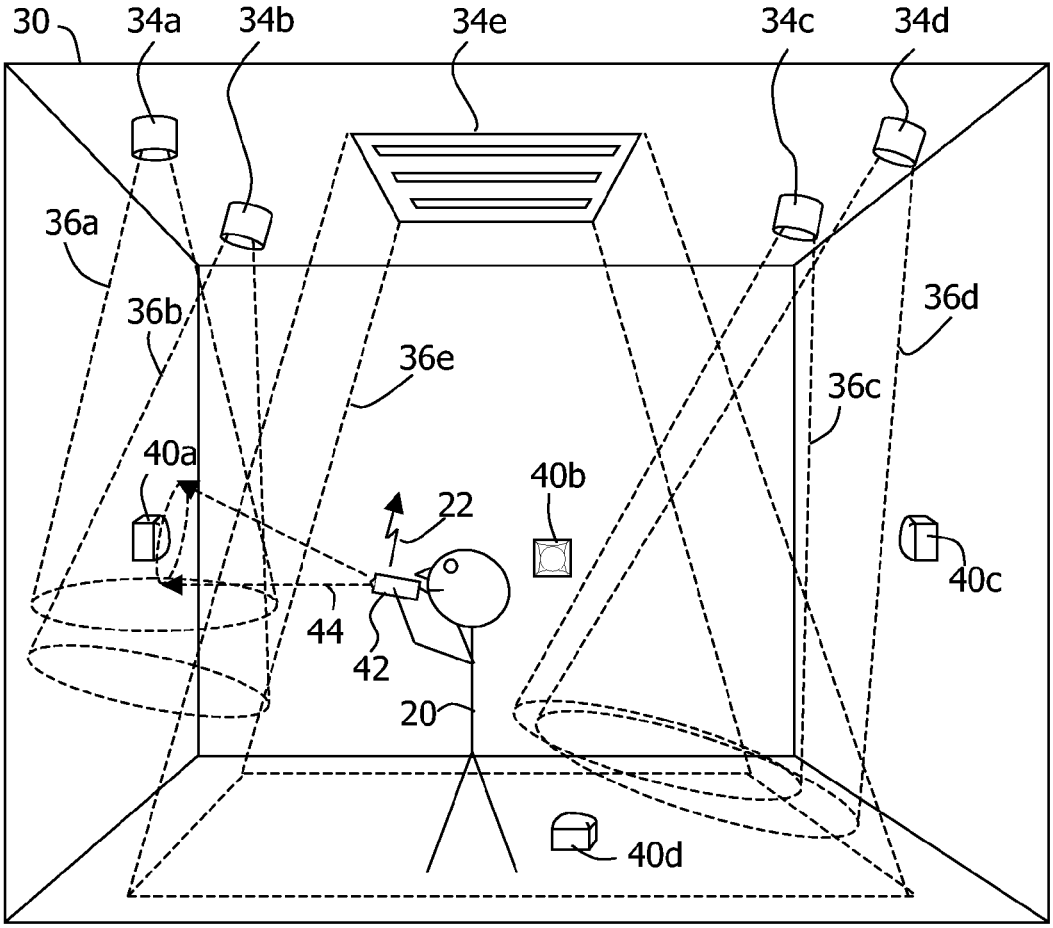
FIG. 3 shows schematically a second embodiment of a lighting system according to the invention.

FIG. 3 illustrates a second embodiment of a lighting system according to the invention. FIG. 3 shows a room 30 in which there are arranged lighting units 34*a*, 34*b*, 34*c*, 34*d* and 34*e* (34 in general). Lighting units 34*a* to 34*d* are illustrated to be spot lights, while lighting unit 34*e* is illustrated as to be a lighting unit for overall lighting of most part of the room (apart from lighting by reflection of light emitted by it). The lighting units 34*a* to 34*e* operate like the lighting unit 6 shown in FIG. 1. With the system of FIG. 3 a lighting unit 34 contains a lighting source, which operates as a modulated light source also. Light radiation patterns of lighting sources of the lighting units 34*a* to 34*e* are indicated by cones 36*a* to 36*e* of a particular light intensity, respectively.

The system of the second embodiment of FIG. 3 further comprises a number of light-sensing devices 40*a*, 40*b*, 40*c* and 40*d* (40 in general), which are mounted in different locations in the room 30. Each light-sensing device 40 has a light sensitive area or a viewing area in which it can sense adequately light of a particular intensity or stronger. For clarity of the drawing the viewing areas of the sensing devices 40 are not shown in FIG. 3. Different sensing devices 40 will sense light emitted by different lighting units 36 with different intensities.

The system further comprises a remote control device 42 which can be held by hand by a user 20. Different from the first embodiment the remote control 42 does not sense light but, on command of the user, it emits light as a wireless control signal, which contains an activation command. A cone 44 indicates an intensity of the wireless control signal having an intensity, which is a minimum intensity to usably be received by a sensing device 40. When a sensing device 40 senses the wireless control signal and it retrieves the activation command from it, the system will use control data acquired for the sensing device 40 for changing a lighting effect of the area containing the sensing device 40, while maintaining lighting effects of areas containing the other sensing devices 40.

The second lighting system illustrated by FIG. 3 may operate as follows. At some time a common controller switches on the lighting units 34 one by one to emit light with a maximum intensity. Each time a lighting unit 34 is switched on the common controller enables each sensing device 40 to sense if it received light from a lighting unit 34. This is a simple type of light modulation. The common controller may thereby ascertain an identification of a lighting unit 34 from which light is received. The sensing device 40 also measures the intensity of the light it receives and it communicates a value of the measured intensity to the common controller. The common controller stores the data thus acquired. In this way the common controller can establish and holding an array containing for each sensing device 40 a sub array of pairs of an identification of each lighting unit 34 and a value of a highest intensity of light which can be sensed by the sensing device 40 from that lighting unit 34. During normal operation of the system, that is, after having established said array, the user 20 may direct the transmission cone 44 of the remote control device 42 to a sensing device 40 in an area of which he wants to change the lighting of. Then the user 20 operates the remote control device 42 to emit the wireless control signal containing an activation command. When the sensing device 40 receives the activation command it is communicated to the common controller, which is then enabled to use the data stored for said sensing device 40 for changing lighting of the area containing the sensing device 40 to a lighting effect wanted by the user, while maintaining lighting effects in areas containing other sensing devices 40. By the same or a subsequent operation of the remote control device 42 the user 20 may transmit commands to change the lighting provided by the lighting units 34 which, according to the stored data, are associated with the activated sensing device 40. The sensing devices 40 are always in a condition in which they can receive and process the activation command, so that a user may change between different areas containing different light-sensing devices 40 for selectively changing lighting effects in those areas.

Optionally, with the second embodiment of FIG. 3 a light-sensing device 40 may measure intensities of light it receives from different lighting units each time the sensing device 40 receives the activation command. It is necessary then that the lighting sources 34 from which light is received are identified. This can be done in the same way as with the first embodiment of FIG. 1, except that the sensing device 40 is now one fixed sensing device of several fixed sensing devices 40 instead of a sensing device of a handheld remote control device. Also, just like with the first embodiment, the lighting units 34 may have a lighting source and a modulated light source having substantially coinciding light radiation patterns. Measuring light intensities often than once has the advantage that the common controller may detect malfunction of lighting devices 34. It may even detect a rate of aging of each lighting unit 34. This is not possible with the first embodiment because of the unknown location of the remote control device 16 and therewith of its sensing device, which may sense light from any combination of lighting units and with different intensities on different times.

Figure 4:
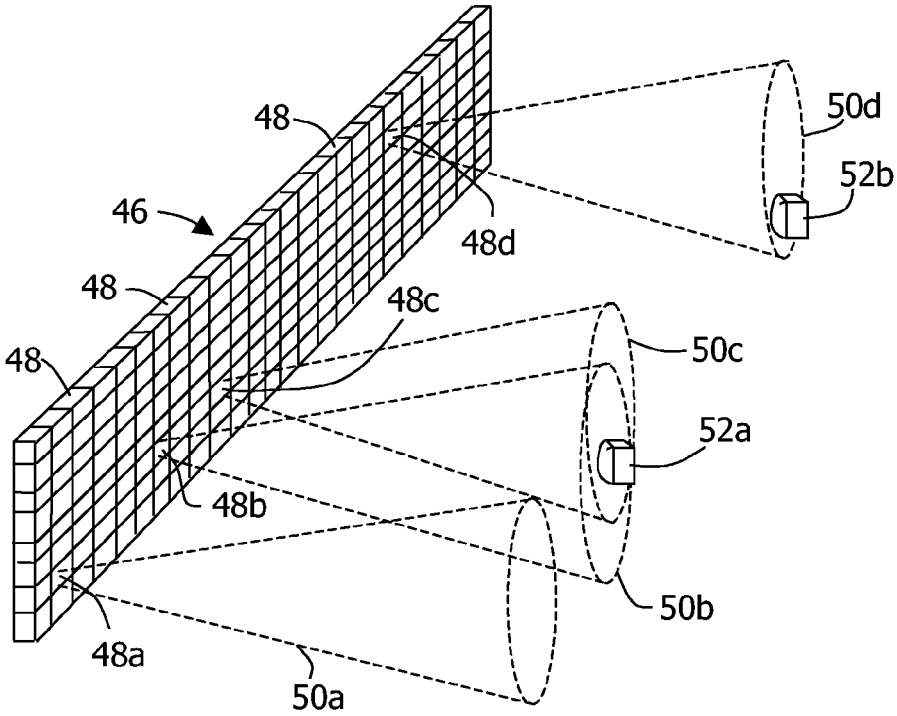
FIG. 4 shows schematically a third embodiment of a lighting system according to the invention.

FIG. 4 illustrates a third embodiment of a lighting system according to the invention. The system of FIG. 4 comprises an array 46 of lighting units 48. The array 46 may be suitable to lighten a room or it may be used to display all kinds of messages and images. It is an object to obtain wanted perceptions of light emitted by the array 46 in different locations. Therefore, in each of said locations a light-sensing device 52 is installed. FIG. 4 shows two sensing devices 52*a* and 52*b* only. In particular each lighting unit 48 operates as a lighting source and as a modulated light source with, inherently, substantially coinciding light radiation patterns, which for some lighting units 48*a*, 48*b*, 48*c*, 48*e* and 48*d* are indicated by cones 50*a*, 50*b*, 50*c*, 50*e* 50*d* having a particular light intensity, respectively. Such lighting units 48 may be light emitting diodes (LED's). However, the system of FIG. 4 is applicable for any number and any size of lighting units and with or without separate modulated light sources. Therefore, the technique explained now for the third embodiment can be applied for the first and second embodiments also.

With the lighting system according to the third embodiment of FIG. 4 the lighting units 48 may emit modulated light at the same time and continuously. To be able to identify from which lighting units 48 a sensing device 52 senses light and by what intensity, the modulated light emitted by a lighting unit 48 is modulated by using a spread spectrum technique. Such a technique is known as "code-division multiplexing/multiple access" (CDM or CDMA). To each lighting unit 48, or to each group of one or more lighting units 48, a unique code is allocated. The codes must be orthogonal. That is, a value of an autocorrelation of a code must be significant higher than a value of a cross-correlation of two different codes. A sensing device 52 is then able to discriminate between simultaneously transmissions of modulated light by different lighting units 48, so that the sensing device 52 can identify each of those lighting units 48 and the sensing device 52 can measure the intensity by which it received the modulated light from the identified lighting unit 48. For each sensed emission of modulated light the sensing device 52 transfers data containing an identification of the emitting lighting unit 48 and a value of the measured intensity of the modulated light received from the lighting unit 48 to a common controller, such as a controller 2 of the first embodiment. Having acquired such data from all sensing devices 48, the controller is able to control lighting units 48 of concern to change the intensity of their emitted light to thereby meet wanted light effects in areas comprising the sensing devices 48.

Figure 5:
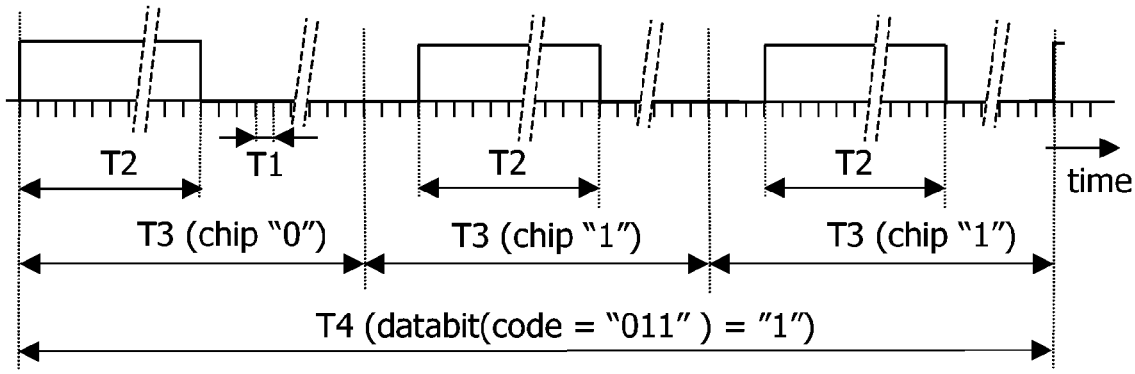
FIG. 5 shows a diagram for illustrating a spread spectrum modulation technique for use with the third embodiment of FIG. 4.

FIG. 5 shows a time diagram for explaining the spread spectrum modulation technique for modulating light which is to be emitted by a lighting unit 48.

The lighting units 48 have a maximum frequency by which their emitted light can be modulated. The inverse of the maximum frequency defines a minimum modulation interval. A clock signal is generated providing pulses having a cycle time which is greater than said minimum modulation interval. It is assumed here that the clock cycle time or period T1 (first interval).

The intensity of light emitted by a lighting unit 48 on average during some time can be controlled by changing a duration of a second interval T2 during which the lighting unit 48 is switched on inside a constant third interval T3, that is, by controlling a duty cycle defined by a ratio of T2/T3. T3 is chosen to be short enough to make the on/off modulation not perceivable by a human.

In addition to the intensity control by controlling the duty cycle T2/T3, the light is modulated by the unique code of the emitting lighting unit 48. The code comprises a number of code bits, which in the field of CDMA are called "chips". A chip has a duration of T3=N*T1, with N being an integer. Therefore, T2=M*T1, with M being a smaller integer than N. To differentiate between a chip value "0" and a chip value "1" the second interval T2 is located at two different locations inside the interval T3, dependent on which chip value must be presented. In the example of FIG. 5 the interval T2 for representing a chip value "1" is delayed by 2*T1 with respect to the interval T2 for a chip representing a chip value "0". The example also shows that the unique code comprises P=3 chips defining a code "011" during a fourth interval T4=P*T3=P*N*T1.

The lighting units 48 may, just like the lighting units 6, 34 of the first and second embodiments, transmit data, such as about properties of the lighting units, as well by proper modulation of the emitted light. With the third embodiment this can be done by using two codes per lighting unit 48, one for representing a "0" data bit (or channel bit) and one for representing a "1" data bit. For example, the two codes may be composed of the same chips, but in reversed order.

It is observed that the concept of the third embodiment with regard to simultaneously emissions of modulated light by different lighting units using a spread spectrum modulation technique can be applied to the first and second embodiments also.

The three embodiments described above have in common that a sensing device identifies all lighting units 6, 34, 48 from which the sensing device senses modulated light, it measures an intensity of the modulated light emitted by each identified lighting unit 6, 34, 48 and it communicates data about that to a common controller to let the controller control the lighting units 6, 34, 48, such as to obtain a wanted lighting or lighting effect in an area in which the sensing device is located. For each embodiment a lighting unit 6, 34, 48 may comprise a light source for emitting the modulated light, which is different from a light source for emitting not modulated light with a higher intensity for lighting of the area in a way that is perceptible for a human. In that case the lighting unit is made such that radiation patterns of the different light sources substantially coincide, as if the lighting unit comprised only one source.

The invention claimed is:

1. A method for controlling a lighting system comprising a plurality of lighting units, each lighting unit being identified by an identification code, and comprising a lighting source for emitting visible light and a modulated light source for emitting a modulated light configured to carry the identification code, a radiation pattern of the modulated light substantially coinciding with a radiation pattern of the illumination light, the method comprising sensing, in a viewing area, at least one attribute of the modulated lights emitted by at least two lighting units of the plurality of lighting units, analyzing the modulating lights to produce control data based on the identification code of each of the at least two lighting units and the at least one attribute of each of the modulated lights, and controlling the at least two lighting units based on the control data.

2. Method according to claim 1, wherein the viewing area is a viewing area of a sensing device of a remote control device.

3. Method according to claim 1, wherein the viewing area is a viewing area of a fixed sensing device.

4. Method according to claim 3, wherein a wireless control signal containing an activation command is transmitted from a remote control device to access one sensing device out of several sensing devices by the activation command, whereby the accessed sensing device is enabled to provide the control data, and remaining sensing devices are disabled.

5. Method according to claim 1, wherein a unique identification is allocated to each modulated light source, and wherein each modulated light source modulates light emitted by it dependent on the identification code, and different modulated light sources are controlled to modulate on different instances.

6. Method according to claim 5, wherein the different instances are random instances, and when sensing collision of emissions of modulated light the modulated light sources are controlled to repeat their emissions of modulated light on random instances.

7. Method according to claim 1, wherein light emitted by the lighting unit is modulated by using spread spectrum modulation.

8. Method according to claim 7, wherein a unique code suitable for spread spectrum modulation is assigned to each of the lighting units, the code being represented by a series of light emission intervals of identical fixed duration (T3), during which different values of the code are represented by different locations of an emission interval (T2) during which only light is emitted, and an average intensity of the emitted light is determined by controlling the duration of the emission interval (T2).

9. A lighting system comprising:

a plurality of lighting units, each lighting unit being identified by an identification code, and configured to emit visible light and a modulated light configured to carry the identification code, and a radiation pattern of the modulated light substantially coinciding with a radiation pattern of the visible light; and a light-sensing device configured to sense, in a viewing area, at least one attribute of modulated lights emitted by at least two lighting units of the plurality of lighting units, and to produce control data based on the identification code of each of the at least two lighting units and the at least one attribute of each of the modulated lights, and a controller configured to control the at least two lighting units based on the control data.

10. Lighting system according to claim 9, wherein said viewing area is an area within boundaries of a sensing cone of said sensing device.

11. Lighting system according to claim 9, wherein the sensing device is a part of a remote control device.

12. Lighting system according to claim 9, wherein the sensing device is one of a plurality of fixed sensing devices and the viewing area is a collection surface of said one of the plurality of fixed sensing devices in an activated state.

13. Lighting system according to claim 12, comprising a remote control device configured to transmit an activation command for selectively turning said one of the plurality of fixed sensing devices into said activated state.

14. Lighting system according to claim 9, wherein each lighting unit includes a modulated light source having a unique identification, each modulated light source emits light modulated by the identification of the modulated light source, and different modulated light sources emit modulated light at different time instances.

15. Lighting system according to claim 14, wherein the different time instances are selected at random.

16. Lighting system according to claim 14, wherein the modulated light source operates to modulate light to be emitted by using a spread spectrum modulation technique.

* * * * *